US007479470B2

(12) United States Patent
Hiroishi et al.

(10) Patent No.: US 7,479,470 B2
(45) Date of Patent: Jan. 20, 2009

(54) THERMAL TRANSFER RECEIVER, METHOD FOR PRODUCING THE SAME, METHOD FOR RECORDING IMAGE, AND RECORDED IMAGE

(75) Inventors: Katsunori Hiroishi, Yokohama (JP); Shigeru Miyajima, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 396 days.

(21) Appl. No.: 11/195,793

(22) Filed: Aug. 3, 2005

(65) Prior Publication Data

US 2006/0046003 A1 Mar. 2, 2006

(30) Foreign Application Priority Data

| | | | |
|---|---|---|---|
| Aug. 4, 2004 | (JP) | ..... | 2004-228611 |
| Mar. 1, 2005 | (JP) | ..... | 2005-055330 |
| Mar. 1, 2005 | (JP) | ..... | 2005-055331 |
| Mar. 4, 2005 | (JP) | ..... | 2005-061396 |

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS

| | | | | |
|---|---|---|---|---|
| 5,073,533 | A * | 12/1991 | Aono | 503/227 |
| 5,573,833 | A * | 11/1996 | Imamura et al. | 428/32.39 |
| 7,081,284 | B2 * | 7/2006 | Hiroishi | 428/32.6 |

FOREIGN PATENT DOCUMENTS

| | | |
|---|---|---|
| GB | 2 175 516 A | 12/1986 |
| JP | 59-187891 | 10/1984 |
| JP | 61-112693 | 5/1986 |
| JP | 61-121993 | 6/1986 |
| JP | 01-228890 | 9/1989 |
| JP | 01-244890 | 9/1989 |
| JP | 02-223495 | 9/1990 |
| JP | 03-199093 | 8/1991 |
| JP | 04-016078 | 1/1992 |
| JP | 04-115995 | 4/1992 |
| JP | 04-275194 | 9/1992 |
| JP | 04-347688 | 12/1992 |
| JP | 05-033157 | 2/1993 |
| JP | 05-034154 | 2/1993 |
| JP | 05-270156 | 10/1993 |
| JP | 05-286227 | 11/1993 |
| JP | 08-043994 | 2/1996 |
| JP | 08-058250 | 3/1996 |
| JP | 2533456 | 6/1996 |
| JP | 09-011653 | 1/1997 |
| JP | 10-077355 | 3/1998 |
| JP | 10-114161 | 5/1998 |
| JP | 2852924 | 11/1998 |
| JP | 11-139010 | 5/1999 |
| JP | 3029058 | 2/2000 |
| JP | 2000-203169 | 7/2000 |
| JP | 2001-199171 | 7/2001 |
| JP | 3246522 | 11/2001 |
| JP | 2001-341259 | 12/2001 |
| JP | 2002-113959 | 4/2002 |
| JP | 3342907 | 8/2002 |
| JP | 2003-048292 | 2/2003 |
| JP | 2004-082727 | 3/2004 |
| JP | 2004-268571 | 9/2004 |
| JP | 2004-299192 | 10/2004 |

* cited by examiner

*Primary Examiner*—Bruce H Hess
(74) *Attorney, Agent, or Firm*—Oblon, Spivak, McClelland, Maier & Neustadt, P.C.

(57) ABSTRACT

The objects of the present invention are to provide a thermal transfer receiver adapted to form transferred images excellent in solvent resistance and superior in wear resistance, a method for producing the thermal transfer receiver, a method for recording an image, and a recorded image. The objects may be attained by the thermal transfer receiver which comprises a support and a receiving layer disposed on the support, and the receiving layer contains a polyethyleneimine derivative, a thermoplastic resin, and a crosslinker.

23 Claims, No Drawings

THERMAL TRANSFER RECEIVER, METHOD FOR PRODUCING THE SAME, METHOD FOR RECORDING IMAGE, AND RECORDED IMAGE

BACKGROUND OF THE INVENTION

1. Field of the Invention

The present invention relates to thermal transfer receivers adapted to form transferred images with excellent solvent resistance and superior wear resistance, methods for producing the same, methods for recording images, and recorded images.

2. Description of the Related Art

Methods for forming images through heating a thermal transfer medium by use of a thermal head and a transferring ink onto a receiving medium are publicly known and are broadly utilized for making labels such as nameplates. When such labels are utilized under circumstances containing organic solvents such as methylethylketone (hereinafter referring sometimes as "MEK"), the images transferred on the labels should be free from erasing under the effect of solvents.

In Japanese Patent Application Laid-Open (JP-A) No. 04-115995, JP-A No. 05-286227, JP-A No. 08-43994, and JP-A No. 08-58250, receivers are disclosed that contain ethylene-ionomer resins in the receiving layer in order to improve ink-transferability and chemical resistance of the receivers. A receiver is proposed in JP-A No. 2002-113959 that comprises a coating layer composed of ethyleneimine additives made from olefin-unsaturated carboxylic acid copolymers and polyimine polymer. However, the solvent resistance is insufficient in these proposals with respect to images formed on the receiving layer and the coating layer.

Further, in order to obtain the adequate solvent resistance of transferred images, same kind of resins superior in solvent resistance are added to the ink layer and the receiving layer. For example, in Japanese Patent (JP-B) No. 2533456, adding a specific polyolefin to the ink resin and the receiving layer is proposed. Also, in JP-A No. 04-347688 and JP-A No. 2001-199171, adding nylon to the ink layer and the receiving layer is proposed. However, these proposals suffer from insufficient solvent resistance of the images for sever applications.

Further, an under layer is provided between the receiving layer and the support in order to strengthen the receiving layer and thus to increase the wear resistance in receivers containing a receiving layer. Specifically, an under layer containing a UV cure resin is provided between the receiving layer and support (e.g. JP-A Nos. 61-112693, 61-121993, 01-228890, 01-244890, 02-223495, and 04-275194). However, these proposals suffer from the insufficient strength of the receiving layer, in particular the lower solvent resistance of images on the receiving layer.

SUMMARY OF THE INVENTION

Accordingly, the objects of the present invention are to provide a thermal transfer receiver adapted to form transferred images excellent in solvent resistance and superior in wear resistance; the method for producing the thermal transfer receiver; the method for recording an image and a recorded image that utilize the thermal transfer receiver.

The thermal transfer receiver according to the present invention comprises a support and a receiving layer disposed on the support, wherein the receiving layer comprises a polyethyleneimine derivative, a thermoplastic resin, and a crosslinker. Consequently, the image transferred on the thermal transfer receiver has excellent resistance against solvents such as MEK as well as superior wear resistance.

The method for producing the thermal transfer receiver according to the present invention comprises coating a support with a coating liquid for the receiving layer, and forming the receiving layer on the support, wherein the coating liquid comprises a polyethyleneimine derivative, a thermoplastic resin, a crosslinker, and water.

In the method for recording an image according to the present invention, an image is transferred thermally by making contact an ink layer of a thermal transfer medium and a receiving layer of a thermal transfer receiver each other, heating the thermal transfer medium, thereby causing thermal transfer from the ink layer to the receiving layer, wherein the thermal transfer receiver comprises a support, a peeling layer comprising a wax disposed on the support, and the ink layer comprising a colorant and a salt of ethylene-methacrylic acid copolymers. Consequently, images can be recorded on the receiving media with excellent resistance to solvents such as MEK and superior wear resistance.

The recorded image according to the present invention is formed on the thermal transfer receiver by the method for recording an image according to the present invention, wherein the image is recorded by way of making contact the ink layer of the thermal transfer medium and the receiving layer of the thermal transfer receiver each other, heating the thermal transfer medium, thereby causing thermal transfer from the ink layer to the receiving layer.

DESCRIPTION OF THE PREFERRED EMBODIMENTS

Thermal Transfer Receiver

The thermal transfer receiver according to the present invention comprises a support and a receiving layer, and other layers such as a metal layer and an under layer depending on the requirements.

Receiving Layer

The receiving layer comprises a polyethyleneimine derivative, a thermoplastic resin, a crosslinker, an inorganic pigment, and the other optional components.

—Polyethyleneimine Derivative—

Examples of polyethyleneimine derivatives include polyethyleneimine produced by ring-opening polymerization of ethyleneimine, ethyleneimine modified polymers in which polyethyleneimine being grafted to side chain of other polymers such as an acrylic polymer, and acrylic polymers modified with polyethyleneimine. Addition of polyethyleneimine derivatives may improve chemical resistance of images to solvents particularly such as methylethylketone, toluene, and xylene. The content of polyethyleneimine derivatives in the receiving layer is preferably 5% by mass to 75% by mass, and more preferably 20% by mass to 60% by mass. When the content is less than 5% by mass, the improvement effect of solvent resistance may be lowered. When the content is more than 75% by mass, the water resistance may be unsatisfactory.

—Thermoplastic Resin—

A thermoplastic resin such as of water soluble resins, aqueous emersions, and aqueous dispersions may be employed properly depending on the purpose.

Examples of the water soluble resins include polyvinyl alcohols such as partially saponified polyvinyl alcohol, completely saponified polyvinyl alcohol, and modified polyvinyl alcohol containing carboxy group, carboxylic acid sodium, sulfonic acid sodium, acetoacetyl group, or cation group;

starch and derivatives thereof; cellulose derivatives such as methoxycellulose, hydroethylcellulose, carboxymethylcellulose, methylcellulose, ethylcellulose; polyacrylic acid, poly (sodium acrylate), polyvinylpyrolidone, acrylamide-acryl acrylate copolymers, acrylamide-acryl acrylate-methacrylic acid terpolymers, alkali salt of styrene maleic anhydride copolymers, alkali salt of isobutylene-maleic anhydride copolymers, polyacrylamide, alginic acid sodium, and gelatin.

Examples of the aqueous emersions and aqueous dispersions include polyvinyl acetate resins, polyurethane resins, styrene-butadiene copolymers, acrylonitrile-butadiene copolymers, styrene-butadiene-acrylic copolymers, methyl methacrylate-butadiene copolymers, polyacrylic ester, polyester methacrylate, vinyl chloride-acetic vinyl copolymers, ethylene-methacrylic acid copolymers, salt of ethylene-methacrylic acid copolymers, ethylene-vinyl acetate copolymers, acetic vinyl-acrylic acid copolymers, ethylene-vinyl acetate-acrylic acid copolymers, urethane modified polyethylene, styrene-acrylic acid ester copolymers, ethylene-propylene copolymers, ethylene-vinyl chloride copolymers, vinyl acetate-ethylene-vinyl chloride copolymers, and polyester. These thermoplastic resins are used individually or in combination. Among the resins, polyester resins, polyurethane resins, methylmethacrylate-butadiene copolymers, and salts of ethylene-methacrylic acid copolymers are preferable; in particular, salts of ethylene-methacrylic acid copolymers are preferable.

Preferably, the molecular mass of the polyester resin is 10,000 to 25,000 and the glass transition temperature (Tg) of the polyesters is 40° C. to 80° C. Specific examples thereof are Vylonal (by Toyobo Co.), Finetechs (by Dainippon Ink and Chemicals Co.), Pesresin A (by Takamatsu Oil & Fat Co.), and the like.

Preferably, the polyurethanes is of polyester type, polyether type, or ester-ether type, and have a preferable glass transition temperature (Tg) of 35° C. to 75° C. Specific examples thereof are Superflex (by Dai-Ichi Kogyo Seiyaku, Co.), Hydran (by Dainippon Ink and Chemicals Co.), and the like.

Preferably, the methyl methacrylate-butadiene copolymers are carboxylated, and have a preferable glass transition temperature (Tg) of −70° C. to 20° C. Specific examples thereof are Lacstarl (by Dainippon Ink and Chemicals Co.), Smartex and Nalster (by Nippon A &L Inc), and the like.

Preferably, the salt of ethylene-methacrylic acid copolymers may have a structure where a part of methacrylic acid is crosslinked between molecular chains by anode ions such as Na, K, Ca, Zn, and $NH_3$. Preferably, the salt comprises at least one of Na, K, and Zn. Preferably, the copolymers contain methacrylic acid in a content of 15% by mass to 25% by mass. Preferably, the copolymers contain 25% by mass to 75% by mass of salt of neutralized methacrylic acid. Since salts of ethylene-methacrylic acid copolymers are typically hardly soluble to general purpose solvents, salts of ethylene-methacrylic acid copolymers which are included into aqueous dispersions are preferably employed in the present invention. Above all, salts of ethylene-methacrylic acid copolymers which are self-emulsified with no dispersions are more preferable. When the aqueous dispersion is emulsified compulsorily with a dispersing agent or soluble resin, the dispersing agent or soluble resin adversely affects water resistance and solvent resistance of the images. Examples of the salts of ethylene-methacrylic acid copolymers include Chemiparl S-650 and S-659 (by Mitsui Chemicals Co.).

Preferably, the content of the thermoplastic resins is 20% by mass to 70% by mass. When the content is less than 20% by mass, the strength of the receiving layer may be lowered, and when the content is more than 70% by mass, the solvent resistance of images may be unsatisfactory.

—Crosslinker—

In the present invention, a crosslinker is added to the receiving layer in order to improve the solvent resistance. Examples of the crosslinker include carbodiimide, oxazoline, isothionate, melamine compounds, epoxy compounds, and multivalent metal salts. Among these crosslinkers, epoxy compounds are preferable, and among the epoxy compounds, aliphatic epoxy compounds are particularly preferable. The epoxy equivalent of epoxy compounds is preferably 150 mg/eq to 200 mg/eq.

Preferably, the content of the crosslinkers in the receiving layer is 0.5% by mass to 20% by mass, and more preferably 1% by mass to 5% by mass. When the content is less than 0.5% by mass, the polymerization may be insufficient, and when the content is more than 20% by mass, the solvent resistance may be deteriorated due to the excessive amount of the crosslinker.

—Inorganic Pigment—

Examples of the inorganic pigment include calcium carbonate, magnesium carbonate, silica, calcium silicate, zinc oxide, titanium oxide, aluminum hydroxide, zinc hydroxide, barium sulfate, clay, kaolin, calcined kaolin, and talc. Among these, calcium carbonate and calcined kaolin are preferable; and among calcium carbonates, light calcium carbonate of calcite type is preferable.

Preferably, the particle diameter of the inorganic pigment is 0.5 μm to 4.0 μm, more preferably 1.0 μm to 4.0 μm. When the particle diameter is less than 0.5 μm, the solvent resistance of the image transferred on the receiving layer may be insufficient, and when the particle diameter is more than 4.0 μm, the fineness of the transferred image may be deteriorated.

Preferably, the content of the inorganic pigment in the receiving layer is 10% by mass to 80% by mass, and more preferably 30% by mass to 70% by mass. When the content is less than 10% by mass, the solvent resistance of transferred images may be lower, and when the content is more than 80% by mass, the receiving layer often exhibits higher opacity, which may inhibit proper transparency or silver-color of translucent receivers or silver-color receivers containing a metal-deposited layer at the back side.

The receiving layer may contain optional additives such as lubricants e.g. higher fatty acid metal salts and paraffin waxes, defoamers, and the like, in addition to the inorganic pigments.

Preferably, the thickness of the receiving layer is 0.3 μm to 8.0 μm, more preferably 1.0 μm to 8.0 μm. When the thickness is less than 0.3 μm, the receiving layer is hardly formed into uniform, and when more than 8.0 μm, the receiving layer easily separate from the support due to frictional force.

Preferably, the surface of the receiving layer exhibits a smoothness of 200 seconds to 3,000 seconds determined in accordance with Japanese Industrial Standards (JIS) P-8119, more preferably is 200 seconds to 1,500 seconds, still more preferably is 200 seconds to 500 seconds. The smoothness below 200 seconds tends to deteriorate the image fineness, and the smoothness above 3,000 seconds often degrades the solvent resistance of images.

The surface smoothness of the receiving layer may be adjusted into 200 seconds to 3,000 seconds by way of employing a roughened film for the support and/or adding a pigment into the receiving layer.

Support

Preferably, a plastic film is employed for the support of the thermal transfer receiver. Preferably, a laminate is employed for the support formed from plural films and adhesive layers therebetween, since such a support typically exhibits proper resilience, thus the receiving layer on the support as well as the images on the receiving layer may be far from damages such as destruction and falling even under vigorous rubbing.

Preferably, the support is of polyester film having a specific gravity of 0.9 to 1.2. Conventional polyester films having a specific gravity of about 1.4 often degrade the wear resistance of images due to lower cushioning ability.

Polyester films having a specific gravity of 0.9 to 1.2 may be prepared by way of incorporating small voids therein at producing the film, for example. The specific gravity of less than 0.9 may lead to insufficient strength for the support, and the specific gravity of more than 1.2 tends to bring about insufficient cushioning ability and thus lower wear resistance of printed images.

Commercially available polyester films having a specific gravity of 0.9 to 1.2 are exemplified by Crisper (by Toyobo Co.) and Lumirror (by Toray Industries, Inc.) of white color and lower specific gravity.

Examples of the material of the support include polyester, polyethylene, polypropylene, polyvinyl chloride, polyethersulfone, polyphenylenesulfide, polyetherimide, polyetheretherketone, polyimide, nylon, and vinylon. Also, synthetic paper produced by coating a resin such as polyolefin or polyester on raw paper may be used as the support. Among these, the plastic films having roughened surface are especially preferable. The receiving layer disposed on the plastic film having roughened surface may improve solvent resistance still more. Preferably, the roughened surface has a smoothness of 100 seconds to 300 seconds in accordance with JIS P8119.

Several methods are available in order to roughen the surface of plastic films. One example of the methods is an emboss method that processes plastic films by an emboss roller, wherein the roughness of the surface may be adjusted by the roughness of the applied emboss roller. Another example of the methods is a sand blast method that mattes plastic films by blasting a large amount of fine particles on the surface, wherein the roughness may be adjusted by such factors as the size and rate of the blasted particles. Further, a matte film may be used that is included a matte agent during production thereof The respective films in the laminate may be of the same or different materials. Preferably, polyethylene terephthalate films are utilized from the viewpoint of strength, thermal resistance, and cost.

Further, silver-colored thermal transfer receivers for recording images may be produced by providing a metal layer on the surface of the support or between the elementary films of the support. The metal layer may be of aluminum, silver, zinc, or the like; preferably the metal layer is of aluminum. The metal layer may be provided on the surface of the support or between the films of the support by plating processes such as electric plating and chemical plating; physical vapor deposition processes such as vacuum deposition, ion plating, spattering, and beam process; and chemical vapor deposition processes such as thermal CVD, plasma CVD, optical CVD, and laser CVD. Preferably, the thickness of the metal layer is 0.001 μm to 10 μm, more preferably about 0.01 μm to 1 μm.

Preferably, each of the laminated films has a thickness of 5 μm to 75 μm, more preferably 10 μm to 50 μm.

The adhesive utilized to form the adhesive layer may be selected from conventional adhesives such as of urea resins, melamine resins, phenol resins, epoxy resins, vinyl acetate resins, vinylacetate-acryl copolymer resins, EVA resins, acryl resins, polyvinylether resins, vinylchloride-vinylacetate resins, polystyrene resins, polyester resins, polyurethane resins, polyamide resins, polychlorinated-polyolefin resins, polyvinylbutyral resins, acrylate copolymers, methacrylate copolymers, natural rubbers, cyanoacrylates, and silicones. The adhesive layer may optionally include a hardener, plasticizer, filler, and antioxidant. Preferably, the thickness of the adhesive layer is 1 μm to 20 μm.

Preferably, the thickness of the support, formed from plural films laminated through adhesive layers, is 20 μm to 300 μm, more preferably 25 μm to 250 μm.

Further, using transparent or translucent plastic films as the support, the silver-colored receiver may be produced by depositing metal layer on at least one side of the plastic film. The metal layer may be of aluminum, silver, zinc, or the like formed on the plastic film by way of vacuum deposition, electron beam deposition, sputtering, or the like. Among these metals, aluminum is especially preferable. Preferably, the thickness of the deposited metal layer is 0.01 μm to 0.1 μm.

An under layer may be disposed between the receiving layer and the plastic film of the support depending on requirements.

Preferably, an under layer containing a salt of ethylene-methacrylic acid copolymer and a crosslinker is provided between the support and the receiving layer. The under layer may enhance the adhesive strength between the support and the receiving layer.

The salt of ethylene-methacrylic acid copolymer and the crosslinker included into the under layer may be the same or similar to that included into the receiving layer. Preferably, the amount of the crosslinker is 0.5% by mass to 5.0% by mass of the salt of ethylene-methacrylic acid copolymer.

Preferably, the under layer contains a UV curable resin and a pigment. Appropriate UV curable resins are exemplified by urethane acrylate oligomers, epoxy acrylate oligomers, polyester acrylate oligomers, and polyol acrylate oligomers. Among these, preferable are urethane acrylate oligomers and/or epoxy acrylate oligomers. An optional acrylate monomer may be added along with these oligomers. A sensitizer may be added to enhance the reactivity through UV rays. Examples of the UV curable resin include Unidic (Dainippon Ink and Chemicals, Inc.)

Preferably, the under layer contains a thermosetting resin and a pigment. Examples of the thermosetting resins include phenol resins, urea resins, melamine resins, alkyd resins, acrylic resins, unsaturated polyester resins, diallylphthalate resins, epoxy resins, and polyurethane resins. These resins may be used alone or in combination. Among these, epoxy resins, melamine resins, unsaturated polyester resins, and combination thereof are preferable in particular.

Further, the under layer may optionally contain a hardening agent and/or hardening accelerator. Examples of the hardening agent include methylethylketone peroxide, cyclohexanone peroxide, benzoyl peroxide, and the like. Examples of the hardening accelerator include cobalt naphthenate, dimethylaniline, and the like.

The pigments included into the under layer are exemplified by inorganic pigments such as calcium carbonate, magnesium carbonate, silica, calcium silicate, zinc oxide, titanium oxide, aluminum hydroxide, zinc hydroxide, barium sulfate, clay, kaolin, calcined kaolin, and talc; organic pigments such as acrylic resin particles, urea-formaldehyde resin particles, melamine resin particles, silicone resin particles, and PTFE particles.

Preferably, the particle diameter of the pigment included into the under layer is 0.5 μm to 4.0 μm. When the particle diameter is less than 0.5 μm, the adhesive strength between the under layer and the receiving layer may be lower due to insufficient irregularity of the surface of the under layer, and when the particle diameter is more than 4.0 μm, the fineness of the transferred images may be deteriorated.

Preferably, the mass ratio of UV curable resin to pigment (UV curable resin: pigment) is 90:10 to 50:50 in the under layer. When the ration of the pigment is less than 10, the adhesive strength between the under layer and the receiving layer may be lower due to insufficient irregularity of the surface of the under layer, and when the ratio of the pigment is above 50, the strength of the under layer is likely to decrease. In addition, the under layer may contain a lubricant, dispersant, defoamer and the like.

Preferably, the thickness of the under layer is 0.5 μm to 3.0 μm. When the thickness is less than 0.5 μm, the effect is not significant to enhance the adhesive strength between the support and the receiving layer, and when above 3.0 μm, the solvent resistance of the transferred images may be deteriorated.

In a silver-color receiver according to the present invention, a metal layer is preferably disposed between the support and the under layer. The metal layer may be of aluminum, silver, zinc, or the like; preferably the metal is aluminum.

The metal layer may be provided by way of plating such as electroplating and chemical plating; physical vapor deposition such as vacuum vapor deposition, ion plating, sputtering, and beam process; and chemical vapor deposition such as thermal CVD, plasma CVD, optical CVD, and laser CVD. Preferably, the thickness of the metal layer is 0.001 μm to 10 μm, more preferably 0.01 μm to 1.0 μm.

Further, a receiving medium may be processed into a label adhesive to the receiving medium by making contact an adhesive layer and a peeling layer on the opposite surface of the receiving layer of the thermal transfer receiver.

The entire thickness of the thermal transfer receiver of the present invention, comprising the support, the receiving layer, and an optional adhesive layer, is preferably 40 μm to 250 μm, and more preferably 70 μm to 150 μm. When the thickness is less than 40 μm, the strength of the thermal transfer receiver may be lowered and in that case the thermal transfer receiver tends to rupture. When the thickness is more than 250 μm, the thermal transfer receiver may be peeled easily due to scratch or collision from the recorded medium.

Method for Producing Thermal Transfer Receiver

The method for producing the thermal transfer receiver according to the present invention comprises disposing the receiving layer by coating on a support with a coating liquid including a polyethyleneimine derivative, a thermoplastic resin, a crosslinker, and water. The method may comprise the other steps depending on requirements.

Examples of the method for coating the receiving layer with the coating liquids include gravure coating, reverse coating, kiss coating, dye coating, metering coating, and knife coating methods.

Preferably, the coated amount of the receiving layer is 0.3 $g/m^2$ to 3.0 $g/m^2$, and more preferably 0.5 $g/m^2$ to 1.0 $g/m^2$. When the amount is less than 0.3 $g/m^2$, the strength of the receiving layer may be lowered, and when the coated amount is more than 3.0 $g/m^2$, solvent resistance of the images may be unsatisfactory.

Preferably, the method for producing the thermal transfer receiver comprises a step of forming an under layer by applying a coating liquid that contains a salt of ethylene-methacrylic acid copolymers, a crosslinker, and water on a support.

Method for Recording Images

The method for recording images according to the present invention comprises making contact an ink layer of a thermal transfer medium and a receiving layer of a thermal transfer receiver each other, heating the thermal transfer medium, and causing thermal transfer from the ink layer to the receiving layer.

Various methods for recording images by causing thermal transfer may be possibly used according to the applications, for example, heating device such as a thermal head and a laser may be used.

Thermal Transfer Medium

The thermal transfer medium comprises a support, a peeling layer containing a wax, and an ink layer containing a colorant as well as a salt of ethylene-methacrylic acid copolymers, in this order, and the other layers depending on requirements. Consequently, it is possible to obtain transferred images with excellent solvent resistance.

—Ink Layer—

The same salt as that applied for the receiving layer of the thermal transfer receiver may be employed for the salt of ethylene-methacrylic acid copolymers used for the ink layer.

In addition to the salt of ethylene-methacrylic acid copolymers, other resins may be added to the ink layer. Examples of the other resins include water soluble resins, emersions, and aqueous dispersions. Examples of the water soluble resins include partially saponified polyvinyl alcohols, completely saponified polyvinyl alcohols, and polyvinyl alcohols such as polyvinyl alcohols modified by carboxyl group, sodium sulfonate group, acetoacetyl group, and cation group; celluloses derivatives such as starch or the derivatives, methoxycellulose, hydroethylcellulose, carboxymethylcellulose, methylcellulose, and ethylcellulose; polyacrylic acid, poly(sodium acrylate), polyvinylpyrolidone, acrylamide-acrylic acid ester copolymers, acrylamide-acrylic acid ester-methacrylic acid terpolymer, alkali salt of styrene-maleic anhydride copolymers, alkali salt of isobutylene-maleic anhydride copolymers, polyacrylamide, alginic acid sodium, and gelatin.

Examples of the emersions or the aqueous dispersions include polyvinyl acetate, polyurethane, styrene-butadiene copolymers, acrylonitrile-butadiene copolymers, styrene-butadiene-acrylic copolymers, polyacrylic acid, polyacrylic acid ester, polymethacrylic acid ester, vinyl chloride-vinyl acetate copolymers, ethylene-vinyl acetate copolymers, vinyl acetate-acrylic acid copolymers, ethylene-vinyl acetate-acrylic acid copolymers, urethane-modified polyethylene, styrene-acrylic acid ester copolymers, ethylene-propylene copolymers, ethylene-vinyl chloride copolymers, vinyl acetate-ethylene-vinyl chloride copolymers, and polyester.

In order to improve the thermal transferability or image resolution, various additives may be added into the ink layer. For example, synthetic waxes such as wax-like fatty acid amide, lubricants, paraffin wax, and natural waxes such as candelilla wax, and carnauba wax may improve the thermal transferability or image definition. In addition to phosphoric ester, various resin particles such as silicone resins, tetrafluoroethylene resins, fluoroalkylether resins may be used as the lubricant.

Further, colorants may be added to the ink layer depending on requirements in terms of tones of color, and the colorant may be selected from carbon blacks, organic pigments, inorganic pigments, or various dyes. The thickness of the ink layer is preferably 0.5 μm to 6.0 μm, and more preferably 0.8 μm to 3 μm.

—Peeling Layer—

The peeling layer comprises binder resins and waxes mainly, and the other components depending on requirements. The peeling layer allows the ink to be peeled off the support when heat energy is applied from the thermal head, thereby the thermal sensitivity may be improved. Also, in the transferred image, the peeling layer exists on the ink layer, thereby the ink layer may be protected from the solvents.

Examples of the binders resin include ethylene-vinyl acetate copolymers, polyamide, polyester, polyurethane, polyvinyl alcohols, polyvinyl acetal, cellulose derivatives, polyvinyl chloride, polyvinylidene chloride, isoprene rubber, butadiene rubber, ethylene-propylene rubber, butyl rubber, and nitrile rubber.

Examples of the waxes include bees wax, spermaceti, Japan wax, rice bran wax, carnauba wax, candelilla wax, montan wax, paraffin wax, polyethylene wax, polyethylene oxide wax, oxidation modified polyethylene wax, microcrystalline wax, oxide wax, ozokerite, ceresin wax, ester wax, margarine acid, lauric acid, myristic acid, palmitic acid, stearic acid, furoin acid, behenin acid, stearilalcohol, behenilalcohol, sorbitan, stearic acid amide, and oleic acid amide. The thickness of the peeling layer is preferably 0.2 μm to 3.0 μm, and more preferably 1.0 μm to 2.0 μm.

Films or paper publicly known may be used for the support. Examples thereof are polyesters such as polyethylene terephthalate; plastic films having relatively high heat resistance such as polycarbonate, triacetylcellulose, nylon, polyimide; cellophane; and parchment paper.

Further, a protection layer may be provided additionally on the back side of the support of the thermal transfer medium depending on requirements. The protection layer is applied in order to protect the support from occasional heat transfer from a heated thermal head. The protection layer may be produced from ultraviolet setting or electro setting resins in addition to thermoplastic resins or thermosetting resins having high heat resistance. Examples of the proper resins for disposing protection layers include fluorocarbon polymers, silicone resins, polyimide resins, epoxy resins, phenol resins, and melamine resins. The resins described above may be used in a thin film form. Furthermore, since addition of protection layer may improve heat resistance of the support, even the materials which have been conventionally considered improper to be used as a support may be used by adding the protection layer described above.

The ink layer and peeling layer may be disposed on the support by hot melt coating method, coating methods using solvents, and the like. The whole thickness of the resulting layer disposed by such a coating method is preferably 0.1 μm to 10 μm, and more preferably 0.5 μm to 6.0 μm.

Recorded Image

The recorded image of the present invention is disposed on the thermal transfer receiver by the method for recording image of the present invention. Since the recorded image of the present invention comprises the transferred image excellent in solvent resistance and superior in wear resistance, the recorded image of the present invention may be used substantially without significant problems under circumstances involving organic solvents such as MEK.

The present invention will be described in further detail with reference to several examples below, which are not intended to limit the scope of the present invention. All parts and percentage (%) are expressed by mass unless indicated otherwise.

EXAMPLE A-1

(1) Production of Thermal Transfer Medium

Polyethylene terephthalate film of having a thickness of 4.5 μm was prepared for the support. The support was coated with silicone rubber SD7226 (by Toray Dow Corning Silicone Co.), on the surface opposite to which a thermal transfer recording layer being disposed, in an amount of 0.35 g/m$^2$ and was dried to prepare a support having a heat-resistant smooth layer.

—Formulation of Peeling Layer—

| | |
|---|---|
| Carnauba wax dispersion in toluene (solid content: 10%) | 90 parts |
| Ethylene-vinyl acetate copolymer resins in toluene[1*)] | 10 parts |

[1*)]solid content: 10%, MFR: 15 dg/min, vinyl acetate: 28%,

The liquid for peeling layer of the formulation described above was coated over the side of the thermal transfer recording layer on the support to a thickness of 1.0 μm, and was dried to form a peeling layer.

—Formulation of Ink Layer—

| | |
|---|---|
| Salt of ethylene-methacrylic acid copolymer[1*)] | 62 parts |
| Aqueous dispersions of carbon black (solid content: 38%) | 22 parts |
| Water | 16 parts |

[1*)]Chemiparl S-650, by Mitsui Chemicals Co., solid content: 27%

The peeling layer was coated with the ink liquid of the above formulation to 0.8 μm thick, and the coating was dried to form an ink layer, thereby to produce a thermal transfer medium.

(2) Preparation of Thermal Transfer Receiver

—Formulation of Receiving Layer—

| | |
|---|---|
| Polyester resin aqueous dispersion Vylonal MD-1245[1*)] | 17 parts |
| Aliphatic epoxy compound (solid content: 100%)[2*)] | 1 part |
| Polyethyleneimine Epomin P-1000 (solid content: 30%)[3*)] | 15 parts |
| Water | 67 parts |

[1*)]by Toyobo Co., solid content: 30%
[2*)]molecular mass: 600, epoxy equivalent: 160 mg/eq
[3*)]by Nippon Shokubai Co., molecular mass: 70,000

The polyester film of 50 μm thick (by Toray Industries, Inc., smoothness: 25,000 seconds) was coated with a receiving-layer liquid of the above formulation in an amount of 2.5 g/m$^2$ after drying, and the receiving-layer liquid was dried to form a receiving layer, thereby to prepare a thermal transfer receiver. The surface of the resulting receiving layer had a smoothness of 3,000 seconds in accordance with JIS P8119.

EXAMPLE A-2

The thermal transfer receiver was produced in the same way as Example A-1, except that the receiving layer was disposed on the sandblasted surface of the polyester film having a thickness of 50 μm and a smoothness of 250 seconds.

The surface of the receiving layer had a smoothness of 450 seconds in accordance with JIS P8119. The same thermal transfer medium was used as that in Example A-1.

EXAMPLE A-3

—Formulation of Receiving Layer—

| | |
|---|---|
| Salt of ethylene-methacrylic acid copolymer[1*)] | 19 parts |
| Aliphatic epoxy compound (solid content: 100%)[2*)] | 1 part |
| Polyethyleneimine Epomin P-1000[3*)] | 15 parts |
| Water | 65 parts |

[1*)]Chemiparl S-650, by Mitsui Chemicals Co., solid content: 27%
[2*)]molecular mass: 600, epoxy equivalent: 160 mg/eq,
[3*)]by Nippon Shokubai Co., solid content: 30%

The sandblasted surface of polyester film having a thickness of 50 μm and a smoothness of 250 seconds was coated with a receiving-layer liquid of the above formula in amount of 0.5 g/m$^2$ after drying, and the receiving-layer liquid was dried to produce a thermal transfer receiver. The surface of the receiving layer had a smoothness of 260 seconds in accordance with JIS P8119. The same thermal transfer medium was used as in Example A-1.

EXAMPLE A-4

Except that a polyester film of pasted matt having a thickness of 50 μm and a surface smoothness of 270 seconds was employed as a plastic film for the receiver, the thermal transfer receiver was produced in the same way as Example A-2. The surface of the receiving layer had a smoothness of 280 seconds in accordance with JIS P8119. The thermal transfer medium was the same as Example A-1.

EXAMPLE A-5

Except that aluminum was vapor-deposited on a surface of polyester film, opposite to which the receiving layer of the receiver being disposed, the thermal transfer receiver was produced in the same way as Example A-3. The surface of the receiving layer had a smoothness of 260 seconds in accordance with JIS P8119. The thermal transfer medium was the same as Example A-1.

EXAMPLE A-6

Except that the receiving layer with the following formulation was disposed, the thermal transfer receiver was produced in the same way as Example A-3.

—Formulation of Receiving Layer—

| | |
|---|---|
| Salt of ethylene-methacrylic acid copolymer[1*)] | 13 parts |
| Aliphatic epoxy compound (solid content: 100%)[2*)] | 1 part |
| Polyethyleneimine Epomin P-1000[3*)] | 7 parts |
| Calcium carbonate aqueous dispersion[4*)] | 16 parts |
| Water | 63 parts |

[1*)]Chemiparl S-650, by Mitsui Chemicals Co., solid content: 27%
[2*)]molecular mass: 600, epoxy equivalent: 160 mg/eq
[3*)]by Nippon Shokubai Co., solid content: 30%
[4*)]particle size: 1.0 μm, solid content: 25%

The surface of the obtained receiving layer had a smoothness of 210 seconds in accordance with JIS P8119. The thermal transfer medium was the same as Example A-1.

Comparative Example A-1

Except that the receiving layer with the following formulation was disposed, the thermal transfer receiver was produced in the same way as Example A-1.

—Formulation of Receiving Layer—

| | |
|---|---|
| Polyester resin aqueous dispersion Vylonal MD-1335[1*)] | 30 parts |
| Polyethyleneimine Epomin P-1000[2*)] | 3 parts |
| Water | 67 parts |

[1*)]by Toyobo Co., solid content: 30%
[2*)]by Nippon Shokubai Co., solid content: 30%

The surface of the obtained receiving layer had a smoothness of 3,000 seconds in accordance with JIS P8119. The thermal transfer medium was the same as Example A-1.

Comparative Example A-2

Except that the receiving layer with the following formulation was disposed, the thermal transfer receiver was produced in the same way as Example A-1.

—Formulation of Receiving Layer—

| | |
|---|---|
| Polyester resin aqueous dispersion Vylonal MD-1335[1*)] | 32 parts |
| Aliphatic epoxy compound (solid content: 100%)[2*)] | 1 part |
| Water | 67 parts |

[1*)]by Toyobo Co., solid content: 30%
[2*)]molecular mass: 600, epoxy equivalent: 160 mg/eq The surface of the obtained receiving layer had a smoothness of 3,000 seconds in accordance with JIS P8119. The thermal transfer medium was the same as Example A-1.

Comparative Example A-3

Except that the receiving layer with the following formula was applied, the thermal transfer receiver was produced in the same way as Comparative Example A-1.

—Formulation of Receiving Layer—

| | |
|---|---|
| Polyester resin aqueous dispersion Vylonal MD-1335[1*)] | 12 parts |
| Calcium carbonate aqueous dispersion[2*)] | 24 parts |
| Aliphatic epoxy compound (solid content: 100%)[3*)] | 1 part |
| Water | 63 parts |

[1*)]by Toyobo Co., solid content: 30%
[2*)]particle size: 1.0 μm, solid content: 25%
[3*)]molecular mass: 600, epoxy equivalent: 160 mg/eq The surface of the obtained receiving layer had a smoothness of 600 seconds in accordance with JIS P8119. The thermal transfer medium was the same as Example A-1.

The resulting thermal transfer media and the thermal transfer receivers were evaluated with respect to solvent resistance and wear resistance after printing under the following conditions. The results are shown in Table 1.

Printing Condition

Printer: Zebra 96XiIII

Printing speed: 2 inches/second

Printing energy: Tone 26

Solvent Resistance

After the respective transferred images were wetted with methylethylketone (MEK) by use of a cotton swab into which 0.5 cc of MEK had been impregnated, the images of test samples were subjected to rubbing 100 times under a load of 100 g/cm$^2$. Then the images were observed and visually evaluated in 5 ranks according to the following evaluation criteria.

[Evaluation Criteria]

5: no change was observable after rubbing

4: images were legible and minor flaws were observable after rubbing

3: images were legible and some flaws were observable after rubbing

2: illegible images remained after rubbing

1: images disappeared after rubbing

Wear Resistance

Images were rubbed 100 times while applying 30 gf load using a stainless rod of 1 mm in diameter, then the images were evaluated on the base of the same criteria as that of the solvent resistance.

TABLE 1

| | Resistance to MEK | Wear Resistance |
|---|---|---|
| Example A-1 | 3 | 2 |
| Example A-2 | 4 | 3 |
| Example A-3 | 5 | 3 |
| Example A-4 | 5 | 3 |
| Example A-5 | 5 | 3 |
| Example A-6 | 5 | 3 |
| Comp. Example A-1 | 2 | 1 |
| Comp. Example A-2 | Non-testable due to printing failure | Non-testable due to printing failure |
| Comp. Example A-3 | 2 | 1 |

The results shown in Table 1 demonstrate that the respective thermal transfer receivers of Examples A-1 to A-6 can provide the images having superior resistance to methylethylketone and wear resistance compared to those of Comparative Examples A-1 to A-3.

EXAMPLE B-1

(1) Production of Thermal Transfer Medium

Polyethylene terephthalate film having a thickness of 4.5 μm was prepared for the support. The support was coated with silicone rubber SD7226 (by Toray Dow Corning Silicone Co.), on the surface opposite to which a thermal transfer recording layer being disposed, in an amount of 0.35 μm after drying, thereby to provide the support with heat resistance and higher smoothness.

Formulation of Peeling Layer

| | |
|---|---|
| Carnauba wax dispersion in toluene (solid content: 10%) | 90 parts |
| Ethylene-vinyl acetate copolymer resins in toluene[1*)] | 10 parts |

[1*)]solid content: 10%, MFR: 15 dg/min, vinyl acetate: 28%,

The ink layer side of a thermal transfer recording layer of the support was coated with the peeling solution to a thickness of 1.0 μm. The resulting support was dried to form a peeling layer.

Formulation of Ink Layer

| | |
|---|---|
| Salt of ethylene-methacrylic acid copolymer[1*)] | 62 parts |
| Aqueous dispersions of carbon black (solid content: 38%) | 22 parts |
| Water | 16 parts |

[1*)]Chemiparl S-650, by Mitsui Chemicals Co., solid content: 27%

The peeling layer was coated with the ink liquid, and the coating was dried to a thickness of 0.8 μm to form an ink layer, thereby to produce a thermal transfer medium.

(2) Preparation of Thermal Transfer Receiver

Formulation of Adhesive

| | |
|---|---|
| Polyurethane aqueous dispersion (Nonsolbond WA-377)[1*)] | 72 parts |
| Hardener (Nonsolbond C-96)[2*)] | 2 parts |
| Water | 26 parts |

[1*)]by Dainichiseika Chemicals Co.
[2*)]by Dainichiseika Chemicals Co.

The adhesive of the above formulation was coated on the surface of matte-polypropylene film (Trefan YM11, by Toray Industries, Inc.), to which surface a corona-treatment had been applied, and was dried to a thickness of 3.0 μm. The surface of the resulting adhesive layer and a polypropylene film of 20 μm thick (Pylene P-2261, by Toyobo Co.) were laminated and subjected to heat-treatment at 40° C. for 2 days, thereby to prepare a support.

Formulation of Receiving Layer

| | |
|---|---|
| Aqueous dispersion of calcined kaolin Ansilex[1*)] | 34 parts |
| Salt of ethylene-methacrylic acid copolymer[2*)] | 31 parts |
| Epoxy compound (solid content: 100%)[3*)] | 0.5 part |
| Polyethyleneimine Epomin P-1000 (solid content: 30%)[4*)] | 9 parts |
| Water | 25.5 parts |

[1*)]by Engelhard Co., particle diameter: 0.8 μm, solid content: 25%
[2*)]Chemiparl S-650, by Mitsui Chemicals Co., solid content: 27%
[3*)]epoxy equivalent: 160 mg/eq
[4*)]by Nippon Shokubai Co.

The liquid of receiving layer of the above formulation was coated on the surface of matte-polypropylene film and was dried to a thickness of about 1.0 μm, thereby to obtain a receiving layer. The surface smoothness of the receiving layer was 2,100 seconds in accordance with JIS P8119.

EXAMPLE B-2

The adhesive obtained in Example B-1 was coated on the surface of polyethylene terephthalate film S105 of 25 μm thick (by Toray Industries, Inc.), to which surface corona-treatment had been applied, and was dried to a thickness of 3.0 μm. The surface of the resulting adhesive layer and a matte polyethylene terephthalate film of 12 μm thick (Ester Film E-3120, by Toyobo Co.) were laminated and subjected to heat-treatment at 40° C. for 2 days, thereby to prepare a support.

Formulation of Receiving Layer

| | |
|---|---|
| Aqueous dispersion of light calcium carbonate[1*)] | 34 parts |
| Salt of ethylene-methacrylic acid copolymer[2*)] | 31 parts |
| Epoxy compound (solid content: 100%)[3*)] | 0.5 part |
| Polyethyleneimine Epomin P-1000 (solid content: 30%)[4*)] | 9 parts |
| Water | 25.5 parts |

[1*)]calcite type, oil absorption: 40 cc/100 g, particle diameter: 3.0 μm, solid content: 25%
[2*)]Chemiparl S-650, by Mitsui Chemicals Co., solid content: 27%
[3*)]epoxy equivalent: 160 mg/eq
[4*)]by Nippon Shokubai Co.

The liquid of receiving layer of the above formulation was coated on the surface of matte polyethylene terephthalate film to a thickness of about 1.0 μm and was dried thereby to obtain a receiving layer. The smoothness of the surface of receiving layer was 2,000 seconds in accordance with JIS P8119. The thermal transfer medium was the same as Example B-1.

EXAMPLE B-3

Formulation of Under Layer

| | |
|---|---|
| Salt of ethylene-methacrylic acid copolymer[1*)] | 71.9 parts |
| Epoxy compound (solid content: 100%)[2*)] | 0.6 part |
| Water | 27.5 parts |

[1*)]Chemiparl S-650, by Mitsui Chemicals Co., solid content: 27%
[2*)]epoxy equivalent: 160 mg/eq The liquid of under layer of the formulation described above was coated on the matte polyethylene terephthalate film of the support in Example B-2, and was dried to a thickness of about 1.5 μm to form an under layer. The liquid of receiving layer in Example B-2 was coated on the under layer, and was dried to form a receiving layer of about 1.0 μm thick. The smoothness of the surface of receiving layer was 2,000 seconds in accordance with JIS P8119. The thermal transfer medium was the same as Example B-1.

EXAMPLE B-4

The adhesive used in Example B-1 was coated onto a polyethylene terephthalate film of 25 μm thick (Metalmy S, by Toyo Metallizing Co.), to the surface on which aluminum had been vapor deposited, and was dried to a thickness of 3.0 μm. The surface of the resulting adhesive layer and a matte polyethylene terephthalate film of 12 μm thick (Ester Film E-3120, by Toyobo Co.) were laminated and subjected to heat-treatment at 40° C. for 2 days, thereby to prepare a support. An under layer and a receiving layer were provided on the support in the same manner as Example B-3. The smoothness of the surface of the receiving layer was 2,000 seconds in accordance with JIS P8119.

Reference Example B-1

Except that a polyethylene terephthalate film of 38 μm thick (Embread S-38LS, by Unitika Ltd.) was employed as the support, a thermal transfer receiver was produced in the same way as Example B-1. The smoothness of the surface of the receiving layer was 1,500 seconds in accordance with JIS P8119. The thermal transfer medium was the same as Example B-1.

Comparative Example B-2

Except that the formulation of the receiving layer was changed into as following, a thermal transfer receiver was produced in the same way as Example B-1. The smoothness of the surface of the receiving layer was 2,100 seconds in accordance with JIS P8119. The thermal transfer medium was the same as Example B-1.

| | |
|---|---|
| Aqueous dispersion of calcined kaolin Ansilex[1*)] | 40 parts |
| Carboxylated SBR latex Lacstar DS-205[2*)] | 20 parts |
| Water | 40 parts |

[1*)]by Engelhard Co., particle diameter: 0.8 μm, solid content: 25%
[2*)]by Dainippon Ink and Chemicals Co., solid content: 50%

Printing Condition

Printer: Zebra 96XiIII

Printing speed: 2 inches/second

Printing energy: Tone 26

The solvent resistance and the wear resistance were evaluated as follows. The results are shown in Table 2.

Solvent Resistance (MEK Resistance)

The images were rubbed 100 times by use of a cotton swab containing MEK under a load of 100 g/cm$^2$, and the images were visually evaluated.

[Evaluation Criteria]

5: no change was observable after rubbing

4: images were legible and minor flaws were observable after rubbing

3: images were legible and some flaws were observable after rubbing

2: illegible images remained after rubbing

1: images disappeared after rubbing

Wear Resistance

Images were rubbed 50 times while applying 30 gf load using a stainless rod of 0.5 mm in thickness, then the images were visually evaluated on the base of the criteria as follows.

3: no change was observable after rubbing

2: images were legible and some flaws were observable after rubbing

1: images peeled after rubbing

TABLE 2

| | Resistance to MEK | Wear Resistance |
|---|---|---|
| Example B-1 | 3 | 3 |
| Example B-2 | 4 | 3 |
| Example B-3 | 5 | 3 |
| Example B-4 | 5 | 3 |
| Ref. Example B-1 | 3 | 1 |
| Comp. Example B-2 | 1 | 3 |

The results of Table 2 demonstrate that the images with respect to the thermal transfer receivers of Examples B-1 to B-4 exhibit superior resistance against MEK as well as superior wear resistance.

EXAMPLE C-1

(1) Production of Thermal Transfer Medium

Polyethylene terephthalate film having a thickness of 4.5 μm was prepared for the support. The support was coated with silicone rubber SD7226 (by Toray Dow Corning Silicone Co.), on the surface opposite to which a thermal transfer recording layer being coated, in an amount of 0.35 μm after drying, thereby to provide the support with heat resistance and higher smoothness.

Formulation of Peeling Layer

| | |
|---|---|
| Carnauba wax dispersion in toluene (solid content: 10%) | 90 parts |
| Ethylene-vinyl acetate copolymer resins in toluene[1*)] | 10 parts |

[1*)]solid content: 10%, MFR: 15 dg/min, vinyl acetate: 28%,

The side of the thermal transfer recording layer of the support was coated with the liquid for peeling layer to a thickness of 1.0 μm, and the coating of the liquid was dried to form a peeling layer.

Formulation of Ink Layer

| | |
|---|---|
| Salt of ethylene-methacrylic acid copolymer[1*)] | 62 parts |
| Aqueous dispersions of carbon black (solid content: 38%) | 22 parts |
| Water | 16 parts |

[1*)]Chemiparl S-650, by Mitsui Chemicals Co., solid content: 27%

The peeling layer was coated with the liquid for ink layer, and the coating was dried to a thickness of 0.8 μm to form an ink layer, thereby to produce a thermal transfer medium.

(2) Preparation of Thermal Transfer Receiver

Formulation of Under Layer

| | |
|---|---|
| Polyester acrylate Unidic V-3021[1*)] | 16 parts |
| Silica (P-603, by Mizusawa Industrial Chemicals, Ltd.) | 4 parts |
| MEK | 80 parts |

[1*)]by Dainippon Ink and Chemicals, Inc.

The liquid for the under layer was applied onto a polyester film of 50 μm thick (E5100, by Toyobo Co.) and dried to a thickness of 1.5 μm thick, thereafter exposing a light of high-pressure mercury lamp at 80 W/cm for 10 seconds to cure the under layer.

Formulation of Receiving Layer

| | |
|---|---|
| Salt of ethylene-methacrylic acid copolymer[1*)] | 31 parts |
| Carbodiimide (E-02, by Nisshinbo Industries, Inc.) | 2 parts |
| Polyethyleneimine Epomin P-1000 (solid content: 30%)[2*)] | 3 parts |
| Water | 64 parts |

[1*)]Chemiparl S-650, by Mitsui Chemicals Co., solid content: 27%
[2*)]by Nippon Shokubai Co.

The liquid for receiving layer of the formulation above was applied onto the under layer and dried to a thickness of 2.5 μm thick to form a receiving layer, thereby to produce a thermal transfer receiver.

EXAMPLE C-2

Formulation of Under Layer

| | |
|---|---|
| Urethane acrylate (Unidic V-4221)[1*)] | 16 parts |
| Silica (P-603, by Mizusawa Industrial Chemicals, Ltd.) | 4 parts |
| MEK | 80 parts |

[1*)]by Dainippon Ink and Chemicals Co.

The liquid for the under layer of the formulation was applied onto a polyester film of 50 μm thick (by Toray Industries, Inc.) and dried to a thickness of 1.5 g/m$^2$, thereafter exposing a light of high-pressure mercury lamp at 80 W/cm for 10 seconds to cure the under layer.

Formulation of Receiving Layer

| | |
|---|---|
| Salt of ethylene-methacrylic acid copolymer[1*)] | 31 parts |
| Epoxy compound (solid content: 100%)[2*)] | 1 part |
| Polyethyleneimine Epomin P-1000 (solid content: 30%)[3*)] | 3 parts |
| Water | 65 parts |

[1*)]Chemiparl S-650, by Mitsui Chemicals Co., solid content: 27%
[2*)]epoxy equivalent: 160 mg/eq
[3*)]by Nippon Shokubai Co.

The liquid for receiving layer of the formulation was applied onto the under layer and dried to a thickness of 2.5 μm thick to form a receiving layer, thereby to produce a thermal transfer medium. The thermal transfer medium was the same as Example C-1.

EXAMPLE C-3

Except that the formulation of the under layer was changed into as following, a thermal transfer receiver was produced in the same way as Example C-2. The thermal transfer medium was the same as Example C-1.

Formulation of Under Layer

| | |
|---|---|
| Epoxy acrylate (Unidic V-5500)[1*)] | 16 parts |
| Silica (P-603, by Mizusawa Industrial Chemicals, Ltd.) | 4 parts |
| MEK | 80 parts |

[1*)]by Dainippon Ink and Chemicals Co.

EXAMPLE C-4

Except that the formulation of the receiving layer was changed into as following, a thermal transfer receiver was produced in the same way as Example C-2. The thermal transfer medium was the same as Example C-1.

Formulation of Receiving Layer

| | |
|---|---|
| Salt of ethylene-methacrylic acid copolymer[1*)] | 15 parts |
| Aqueous dispersion of calcium carbonate[2*)] | 16 parts |

-continued

| | |
|---|---|
| Epoxy compound (solid content: 100%)[3*)] | 1 part |
| Polyethyleneimine Epomin P-1000 (solid content: 30%)[4*)] | 3 parts |
| Water | 65 parts |

[1*)]Chemiparl S-650, by Mitsui Chemicals Co., solid content: 27%
[2*)]particle diameter: 2.5 μm, solid content: 25%
[3*)]epoxy equivalent: 160 mg/eq
[4*)]by Nippon Shokubai Co.

Reference Example C-1

Except that the under layer was not disposed and the receiving layer was disposed on the polyester film, a thermal transfer receiver was produced in the same way as Example C-1. The thermal transfer medium was the same as Example C-1.

Reference Example C-2

Except that the formulation of the under layer was changed into as follows, a thermal transfer receiver was produced in the same way as Example C-1. The thermal transfer medium was the same as Example C-1.

Formulation of Under Layer

| | |
|---|---|
| Polyester resin aqueous dispersion Vylonal MD-1200[1*)] | 47 parts |
| Silica (P-603, by Mizusawa Industrial Chemicals, Ltd.) | 4 parts |
| Water | 49 parts |

[1*)]by Toyobo Co., solid content: 34%

Comparative Example C-3

Except that the under layer shown below was provided, a thermal transfer receiver was produced in the same way as Example C-1. The thermal transfer medium was the same as Example C-1.

Formulation of Receiving Layer

| | |
|---|---|
| Aqueous dispersion of calcium carbonate[1*)] | 40.0 parts |
| Polyester resin aqueous dispersion Vylonal MD-1200[2*)] | 29.4 parts |
| Water | 30.6 parts |

[1*)]particle diameter: 1.5 μm, solid content: 25%
[2*)]by Toyobo Co., solid content: 34%

The resulting thermal transfer media and the thermal transfer receivers were evaluated after printing under the following conditions.

Printing Condition

Printer: Zebra 96XiIII

Printing speed: 2 inches/second

Printing energy: Tone 26

Then, the images were evaluated with respect to solvent resistance and wear resistance as follows. The results are shown in Table 3.

(1) Solvent Resistance

After the respective transferred images were wetted with methylethylketone (MEK) by use of a cotton swab into which 0.5 cc of MEK had been impregnated, the images of test samples were subjected to rubbing 200 times under a load of 100 g/cm$^2$. Then the images were observed and visually evaluated according to the following evaluation criteria.

5: no change was observable after rubbing

4: images were legible and minor flaws were observable after rubbing

3: images were legible and some flaws were observable after rubbing

2: illegible images remained after rubbing

1: images disappeared after rubbing (2) Wear Resistance

Images were rubbed 100 times while applying 30 gf load using a stainless rod of 1.0 mm in diameter, then the images were evaluated on the base of the criteria same with the solvent resistance.

TABLE 3

| | Resistance to MEK | Wear Resistance |
|---|---|---|
| Example C-1 | 3 | 4 |
| Example C-2 | 4 | 5 |
| Example C-3 | 4 | 5 |
| Example C-4 | 5 | 5 |
| Ref. Example C-1 | 3 | 1 |
| Ref. Example C-2 | 2 | 2 |
| Comp. Example C-3 | 1 | 3 |

The results of Table 3 demonstrate that the thermal transfer receivers of Examples C-1 to C-4 can bear images with superior resistance against MEK, and also the images can be substantially free from destruction even being rubbed with a relatively sharp object and higher force.

EXAMPLE D-1

(1) Production of Thermal Transfer Medium

Polyethylene terephthalate film having a thickness of 4.5 μm was prepared for the support, and was coated with silicone rubber SD7226 (by Toray Dow Corning Silicone Co.), on the surface opposite to which a thermal transfer recording layer being coated, in an amount of 0.35 μm after drying, thereby to provide the support with heat resistance and higher smoothness.

Formulation of Peeling Layer

| | |
|---|---|
| Carnauba wax dispersion in toluene (solid content: 10%) | 90 parts |
| Ethylene-vinyl acetate copolymer resins in toluene[1*)] | 10 parts |

[1*)]solid content: 10%, MFR: 15 dg/min, vinyl acetate: 28%,

The side of the thermal transfer recording layer of the support was coated with the liquid for peeling layer to a thickness of 1.0 μm, and the coating of the liquid was dried to form a peeling layer.

Formulation of Ink Layer

| | |
|---|---|
| Salt of ethylene-methacrylic acid copolymer[1*)] | 62 parts |
| Aqueous dispersions of carbon black (solid content: 38%) | 22 parts |
| Water | 16 parts |

[1*)]Chemiparl S-650, by Mitsui Chemicals Co., solid content: 27%

The ink liquid of the above formulation was coated on the peeling layer, and the coating was dried to a thickness of 0.8 μm to form an ink layer, thereby to produce a thermal transfer medium.

(2) Preparation of Thermal Transfer Receiver

Formulation of Under Layer

| | |
|---|---|
| Salt of ethylene-methacrylic acid copolymer[1*)] | 71.9 parts |
| Epoxy compound (solid content: 100%)[2*)] | 0.6 part |
| Water | 27.5 parts |

[1*)]Chemiparl S-650, by Mitsui Chemicals Co., solid content: 27%
[2*)]epoxy equivalent: 160 mg/eq The liquid for under layer of the above formulation was coated on polyester film K1212 of 50 μm thick (specific gravity: 1.1, by Toyobo Co.) and was dried to a thickness of 1.5 μm, thereby to form an under layer.

Formulation of Receiving Layer

| | |
|---|---|
| Aqueous dispersion of calcined kaolin Ansilex[1*)] | 40 parts |
| Polyester resin aqueous dispersion Vylonal MD-1245[2*)] | 20 parts |
| Epoxy compound (solid content: 100%)[3*)] | 1 part |
| Polyethyleneimine Epomin P-1000[4*)] | 10 parts |
| Water | 29 parts |

[1*)]by Engelhard Co., particle diameter: 0.8 μm, solid content: 25%
[2*)]by Toyobo Co., solid content: 30%
[3*)]epoxy equivalent: 160 mg/eq
[4*)]by Nippon Shokubai Co., solid content: 30%

The liquid for receiving layer of the above formulation was coated onto the under layer and dried to a thickness of 3.0 μm, thereby to form a receiving layer. The surface of the resulting receiving layer had a smoothness of 1,400 seconds in accordance with JIS P8119.

EXAMPLE D-2

Except that the material of the support was changed into a polyester film of 50 μm thick and 1.0 specific gravity (E63, by Toray Industries, Inc.), a thermal transfer receiver was prepared in the same way as Example D-1. The surface of the resulting receiving layer had a smoothness of 1,300 seconds in accordance with JIS P8119. The thermal transfer medium was the same as Example D-1.

EXAMPLE D-3

Except that the liquid for receiving layer was changed into that of the following formulation, a thermal transfer receiver was prepared in the same way as Example D-1. The surface of the resulting receiving layer had a smoothness of 950 seconds in accordance with JIS P8119. The thermal transfer medium was the same as Example D-1.

Formulation of Receiving Layer

| | |
|---|---|
| Aqueous dispersion of light calcium carbonate[1*)] | 40 parts |
| Polyester resin aqueous dispersion Vylonal MD-1245[2*)] | 20 parts |
| Epoxy compound (solid content: 100%)[3*)] | 1 part |

-continued

| | |
|---|---|
| Polyethyleneimine Epomin P-1000[4*)] | 10 parts |
| Water | 29 parts |

[1*)]calcite type, oil absorption: 40 cc/100 g, particle diameter: 3.0 μm, solid content: 25%
[2*)]by Toyobo Co., solid content: 30%
[3*)]epoxy equivalent: 160 mg/eq
[4*)]by Nippon Shokubai Co., solid content: 30%

EXAMPLE D-4

Except that the liquid for receiving layer was changed into that of the following formulation, a thermal transfer receiver was prepared in the same way as Example D-1. The surface of the resulting receiving layer had a smoothness of 950 seconds in accordance with JIS P8119. The thermal transfer medium was the same as Example D-1.

Formulation of Receiving Layer

| | |
|---|---|
| Aqueous dispersion of light calcium carbonate[1*)] | 34 parts |
| Salt of ethylene-methacrylic acid copolymer[2*)] | 31 parts |
| Epoxy compound (solid content: 100%)[3*)] | 0.5 part |
| Polyethyleneimine Epomin P-1000[4*)] | 9 parts |
| Water | 25.5 parts |

[1*)]calcite type, oil absorption: 40 cc/100 g, particle diameter: 3.0 μm, solid content: 25%
[2*)]Chemiparl S-650, by Mitsui Chemicals Co., solid content: 27%
[3*)]epoxy equivalent: 160 mg/eq
[4*)]by Nippon Shokubai Co., solid content: 30%

EXAMPLE D-5

Except that the support was changed into a polyester film of 50 μm thick and 1.0 specific gravity (E63, by Toray Industries, Inc.) having a vapor-deposited aluminum layer on the surface, a thermal transfer receiver was prepared in the same way as Example D-4. The surface of the resulting receiving layer had a smoothness of 900 seconds in accordance with JIS P8119. The thermal transfer medium was the same as Example D-1.

Reference Example D-1

Except that the support was changed into a polyester film of 50 μm thick and 1.4 specific gravity (S10, by Toray Industries, Inc.), a thermal transfer receiver was prepared in the same way as Example D-1. The surface of the resulting receiving layer had a smoothness of 1,450 seconds in accordance with JIS P8119. The thermal transfer medium was the same as Example D-1.

Comparative Example D-2

Except that the under layer was not disposed and the liquid for receiving layer of the formulation described below was employed, a thermal transfer receiver was prepared in the same way as Example D-1. The surface of the resulting receiving layer had a smoothness of 1,350 seconds in accordance with JIS P8119. The thermal transfer medium was the same as Example D-1.

Formulation of Receiving Layer

| | |
|---|---|
| Aqueous dispersion of calcined kaolin Ansilex[1*)] | 40 parts |
| Latex of styrene-butadiene copolymer[2*)] | 20 parts |
| Water | 40 parts |

[1*)]by Engelhard Co., particle diameter: 0.8 μm, solid content: 25%
[2*)]SR-100, by Nippon A&L Inc., solid content: 51%

The resulting thermal transfer receivers were evaluated as followings, after being printed under the conditions shown below.

Printing Condition
Printer: Zebra 96XiIII
Printing speed: 2 inches/second
Printing energy: Tone 25
The solvent resistance and the wear resistance were evaluated as follows. The results are shown in Table 4.

Solvent Resistance (MEK Resistance)
After the respective transferred images were wetted with methylethylketone (MEK) by use of a cotton swab into which 0.5 cc of MEK had been impregnated, the images of test samples were subjected to rubbing 50 times under a load of 100 g/cm$^2$, then the images were visually evaluated according to the following criteria.

[Evaluation Criteria]
5: no change was observable after rubbing
4: images were legible and minor flaws were observable after rubbing
3: images were legible and some flaws were observable after rubbing
2: illegible images remained after rubbing
1: images disappeared after rubbing Wear Resistance
Images were rubbed 50 times while applying 30 gf load using a stainless rod of 0.5 mm in thickness, then the images were visually evaluated on the base of the criteria as follows.
3: no change was observable after rubbing
2: images were legible and some flaws were observable after rubbing
1: images peeled after rubbing

TABLE 4

| | Resistance to MEK | Wear Resistance |
|---|---|---|
| Example D-1 | 3 | 3 |
| Example D-2 | 4 | 3 |
| Example D-3 | 4 | 3 |
| Example D-4 | 5 | 3 |
| Example D-5 | 5 | 3 |
| Ref. Example D-1 | 4 | 1 |
| Comp. Example D-2 | 1 | 2 |

The results of Table 4 demonstrate that the images formed on thermal transfer receivers of Examples D-1 to D-5 exhibit superior resistance against MEK and also excellent wear resistance.

EXAMPLE E-1

(1) Production of Thermal Transfer Medium
Polyethylene terephthalate film having a thickness of 4.5 μm was prepared for the support, and was coated with silicone rubber SD7226 (by Toray Dow Corning Silicone Co.), on the surface opposite to which a thermal transfer recording layer being coated, in an amount of 0.35 μm after drying, thereby to provide the support with heat resistance and higher smoothness.

Formulation of Peeling Layer

| | |
|---|---|
| Carnauba wax dispersion in toluene (solid content: 10%) | 90 parts |
| Ethylene-vinyl acetate copolymer resins in toluene[1*)] | 10 parts |

[1*)]solid content: 10%, MFR: 15 dg/min, vinyl acetate: 28%,

The side of the thermal transfer recording layer of the support was coated with the liquid for peeling layer to a thickness of about 1.0 μm, and the coating of the liquid was dried to form a peeling layer.

Formulation of Ink Layer

| | |
|---|---|
| Salt of ethylene-methacrylic acid copolymer[1*)] | 62 parts |
| Aqueous dispersions of carbon black (solid content: 38%) | 22 parts |
| Water | 16 parts |

[1*)]Chemiparl S-650, by Mitsui Chemicals Co., solid content: 27%

The ink liquid of the above formulation was coated on the peeling layer, and the coating was dried to a thickness of 0.8 μm to form an ink layer, thereby to produce a thermal transfer medium.

(2) Preparation of Thermal Transfer Receiver

Formulation of Under Layer

| | |
|---|---|
| Thermosetting resin SF409 (solid content: 37%)[1*)] | 35 parts |
| Calcium carbonate (average particle diameter: 0.6 μm) | 7 parts |
| MEK | 58 parts |

[1*)]mixture of epoxy resin and melamine resin by Dainippon Ink and Chemicals, Inc.

The liquid for under layer of the above formulation was coated on polyester film E5100 of 50 μm thick (by Toyobo Co.) and was dried to a thickness of 0.8 μm, then was subjected to heat treatment at 150° C. for 30 seconds.

Formulation of Receiving Layer

| | |
|---|---|
| Salt of ethylene-methacrylic acid copolymer[1*)] | 15 parts |
| Aqueous dispersion of calcium carbonate[2*)] | 16 parts |
| Epoxy compound (solid content: 100%)[3*)] | 1 part |
| Polyethyleneimine Epomin P-1000 (solid content: 30%)[4*)] | 3 parts |
| Water | 65 parts |

[1*)]Chemiparl S-650, by Mitsui Chemicals Co., solid content: 27%
[2*)]particle diameter: 2.5 μm, solid content: 25%
[3*)]epoxy equivalent: 160 mg/eq
[4*)]by Nippon Shokubai Co., solid content: 30%

The liquid for receiving layer of the above formulation was coated onto the under layer and dried to a thickness of 0.5 μm, thereby to form a thermal transfer receiver. The surface of the resulting receiving layer had a smoothness of 2,200 seconds.

EXAMPLE E-2

Except that the formulation of the under layer was changed into the following, a thermal transfer receiver was prepared in the same way as Example E-1. The thermal transfer medium was the same as Example E-1. The surface of the resulting receiving layer had a smoothness of 2,300 seconds.

Formulation of Under Layer

| | |
|---|---|
| Thermosetting resin SF-C-329 (solid content: 43%)[1*)] | 29 parts |
| Calcium carbonate (average particle diameter: 0.6 μm) | 7 parts |
| Hardening agent SP Hardener B[2*)] | 1 part |
| MEK | 63 parts |

[1*)]mixture of unsaturated polyester resin and melamine resin by Dainippon Ink and Chemicals, Inc.
[2*)]by Dainippon Ink and Chemicals, Inc.

EXAMPLE E-3

Formulation of Under Layer

| | |
|---|---|
| Thermosetting resin SF-C-329 (solid content: 43%)[1*)] | 36 parts |
| Particles of crosslinked polymethylmethacrylate[2*)] | 4 parts |
| Hardening agent SP Hardener B[3*)] | 1 part |
| MEK | 59 parts |

[1*)]mixture of unsaturated polyester resin and melamine resin by Dainippon Ink and Chemicals, Inc.
[2*)]MA1002, by Nippon Shokubai Co., average particle diameter: 2.5 μm
[3*)]by Dainippon Ink and Chemicals, Inc.

The liquid for under layer of the above formulation was coated on polyester film E5100 of 50 μm thick (by Toyobo Co.) and was dried to a thickness of about 1.5 μm, then was subjected to heat treatment at 150° C. for 30 seconds.

A receiving layer was provided on the under layer in the same manner as Example E-1, thereby to form a thermal transfer receiver. The thermal transfer medium was the same as Example E-1. The surface of the resulting receiving layer had a smoothness of 1,200 seconds.

Reference Example E-1

Except that no under layer was provided and the receiving layer was disposed on the polyester film, a thermal transfer receiver was prepared in the same way as Example E-1. The thermal transfer medium was the same as Example E-1. The surface of the resulting receiving layer had a smoothness of 4,800 seconds.

Reference Example E-2

Except that the formulation of the under layer was changed into the following, a thermal transfer receiver was prepared in the same way as Example E-1. The thermal transfer medium was the same as Example E-1. The surface of the resulting receiving layer had a smoothness of 3,500 seconds.

Formulation of Under Layer

| | |
|---|---|
| Thermosetting resin SF409 (solid content: 37%)[1*)] | 47 parts |
| MEK | 53 parts |

[1*)]mixture of epoxy resin and melamine resin by Dainippon Ink and Chemicals, Inc.

Reference Example E-3

Except that the formulation of the under layer was changed into the following, a thermal transfer receiver was prepared in the same way as Example E-1. The thermal transfer medium was the same as Example E-1. The surface of the resulting receiving layer had a smoothness of 2,400 seconds.

Formulation of Under Layer

| | |
|---|---|
| Aqueous dispersion Hydrun AP-10 (solid content: 30%)[1*)] | 43 parts |
| Calcium carbonate (average particle diameter: 0.6 μm) | 7 parts |
| Water | 50 parts |

[1*)]polyester-urethane resin, by Dainippon Ink and Chemicals, Inc.

Comparative Example E-4

Except that a receiving layer shown below was provided, a thermal transfer receiver was prepared in the same way as Example E-1. The thermal transfer medium was the same as Example E-1. The surface of the resulting receiving layer had a smoothness of 2,300 seconds.

Formulation of Receiving Layer

| | |
|---|---|
| Aqueous dispersion of calcium carbonate[1*)] | 40 parts |
| SBR emulsion SN-348[2*)] | 21 parts |
| Water | 39 parts |

[1*)]particle diameter: 2.5 μm, solid content: 25%
[2*)]by Nippon A&L Inc., solid content: 48%

The resulting thermal transfer media and the thermal transfer receivers were evaluated after printing under the following conditions.

Printing Condition
Printer: Zebra 96XiIII
Printing speed: 2 inches/second
Printing energy: Tone 26
The evaluated properties were as follows.

(1) Solvent Resistance
After the respective transferred images were wetted with methylethylketone (MEK) by use of a cotton swab into which 0.5 cc of MEK had been impregnated, the images of test samples were subjected to rubbing 200 times under a load of 100 g/cm$^2$. Then the images were observed and visually evaluated according to the following evaluation criteria.
5: no change was observable after rubbing
4: images were legible and minor flaws were observable after rubbing
3: images were legible and some flaws were observable after rubbing
2: illegible images remained after rubbing
1: images disappeared after rubbing (2) Wear Resistance
Images were rubbed 100 times while applying 30 gf load using a stainless rod of 1.0 mm in diameter, then the images were evaluated on the base of the criteria same with the solvent resistance.
The results are shown in Table 5.

TABLE 5

| | Resistance to MEK | Wear Resistance |
|---|---|---|
| Example E-1 | 3 | 4 |
| Example E-2 | 4 | 5 |

TABLE 5-continued

| | Resistance to MEK | Wear Resistance |
|---|---|---|
| Example E-3 | 5 | 5 |
| Ref. Example E-1 | 3 | 1 |
| Ref. Example E-2 | 3 | 1 |
| Ref. Example E-3 | 2 | 2 |
| Comp. Example E-4 | 1 | 3 |

The results of Table 5 demonstrate that the images formed on thermal transfer receivers of Examples E-1 to E-3 exhibit superior resistance against MEK and are free from damages even under vigorous rubbing using a sharp material.

Recorded images with superior resistance against solvents such as MEK as well as excellent wear resistance may be obtained by using thermal transfer receivers of the invention and transferring images from thermal transfer media.

What is claimed is:

1. A thermal transfer receiver, comprising:

a support, and a receiving layer disposed on the support, wherein the receiving layer comprises a polyethyleneimine derivative, a thermoplastic resin, and a crosslinker, a smoothness of the surface of the receiving layer is 200 seconds to 3,000 seconds in accordance with JIS P8119, and the support is a polyester film having a specific gravity of 0.9 to 1.2.

2. The thermal transfer receiver according to claim 1, wherein a surface of the polyester film on which the receiving layer is disposed is roughened.

3. The thermal transfer receiver according to claim 1, wherein the support is a laminate comprising plural films and at least one adhesive layer interposed between the plural films.

4. The thermal transfer receiver according to claim 3, wherein the the laminate comprising plural films comprises a polyethylene terephthalate film.

5. The thermal transfer receiver according to claim 3, wherein the the laminate comprising plural films comprises a metal layer.

6. The thermal transfer receiver according to claim 1, wherein a metal layer is disposed on at least one surface of the support.

7. The thermal transfer receiver according to claim 1, wherein the thermoplastic resin is a salt of an ethylene-methacrylic acid copolymer.

8. The thermal transfer receiver according to claim 1, wherein the crosslinker is an epoxy compound.

9. The thermal transfer receiver according to claim 1, wherein the receiving layer further comprises at least one inorganic pigment selected from the group consisting of calcium carbonate and calcined kaolin.

10. The thermal transfer receiver according to claim 9, wherein a particle diameter of the inorganic pigment is 0.5 μm to 4.0 μm.

11. The thermal transfer receiver according to claim 1, wherein a thickness of the receiving layer is 0.3 μm to 8.0 μm.

12. The thermal transfer receiver according to claim 1, further comprising an under layer disposed between the support and the receiving layer.

13. The thermal transfer receiver according to claim 12, further comprising a metal layer disposed between the support and the under layer.

14. The thermal transfer receiver according to claim 12, wherein the under layer comprises a UV curable resin and a pigment.

15. The thermal transfer receiver according to claim 14, wherein the UV curable resin is one selected from the group consisting of urethane acrylates and epoxy acrylates.

16. The thermal transfer receiver according to claim 12, wherein the under layer comprises a thermosetting resin and a pigment.

17. The thermal transfer receiver according to claim 16, wherein the thermosetting resin is at least one selected from the group consisting of epoxy resins, melamine resins, and unsaturated polyester resins.

18. The thermal transfer receiver according to claim 12, wherein a thickness of the under layer is 0.5 μm to 3.0 μm.

19. A method for producing a thermal transfer receiver comprising:

coating a support with a coating liquid for a receiving layer, and forming the receiving layer on the support, wherein the coating liquid comprises:

a polyethyleneimine derivative, a thermoplastic resin, a crosslinker, and water, and a smoothness of the surface of the receiving layer formed is 200 seconds to 3,000 seconds in accordance with JIS P8119 and the support is a polyester film having a specific gravity of 0.9 to 1.2.

20. The method for producing a thermal transfer receiver according to claim 19, wherein a coated amount of the receiving layer is 0.3 $g/m^2$ to 3.0 $g/m^2$.

21. The method for producing a thermal transfer receiver according to claim 19, further comprising:

coating a liquid for under layer on the support, and forming an under layer prior to coating with a coating liquid, wherein the liquid for under layer comprises a salt of ethylene-metharylic acid copolymers, a crosslinker, and water.

22. A method for recording an image, comprising:

contacting an ink layer of a thermal transfer medium and the receiving layer of a thermal transfer receiver according to claim 1, heating the thermal transfer medium, and thermally transferring ink from the ink layer to the receiving layer, wherein the thermal transfer medium comprises a support, a peeling layer comprising a wax, and the ink layer, in this order, and the ink layer comprises a colorant and a salt of an ethylene methacrylic acid copolymer.

23. An image recorded on a thermal transfer receiver according to the method for recording an image of claim 22.

* * * * *